US010269286B2

(12) United States Patent
Zhang et al.

(10) Patent No.: US 10,269,286 B2
(45) Date of Patent: Apr. 23, 2019

(54) GAMMA CORRECTION METHOD AND GAMMA CORRECTION DEVICE FOR DISPLAY MODULE

(71) Applicants: BOE Technology Group Co., Ltd., Beijing (CN); Ordos Yuansheng Optoelectronics Co., Ltd., Inner Mongolia (CN)

(72) Inventors: Zhiguang Zhang, Beijing (CN); KwangGyun Jang, Beijing (CN); Chang Zhang, Beijing (CN); Hualing Yang, Beijing (CN); Jing Liu, Beijing (CN)

(73) Assignees: BOE TECHNOLOGY GROUP CO., LTD., Beijing (CN); ORDOS YUANSHENG OPTOELECTRONICS CO., LTD., Inner Mongolia (CN)

( * ) Notice: Subject to any disclaimer, the term of this patent is extended or adjusted under 35 U.S.C. 154(b) by 98 days.

(21) Appl. No.: 15/228,025

(22) Filed: Aug. 4, 2016

(65) Prior Publication Data

US 2017/0278448 A1 Sep. 28, 2017

(30) Foreign Application Priority Data

Mar. 24, 2016 (CN) ..... 2016 1 0173900

(51) Int. Cl.
*G09G 3/20* (2006.01)
*G09G 3/3225* (2016.01)

(52) U.S. Cl.
CPC ..... *G09G 3/2074* (2013.01); *G09G 3/2003* (2013.01); *G09G 3/3225* (2013.01);
(Continued)

(58) Field of Classification Search
CPC .. G09G 3/2074; G09G 3/2003; G09G 3/3225; G09G 2320/0276; G09G 2320/0626; G09G 2320/0673
See application file for complete search history.

(56) References Cited

U.S. PATENT DOCUMENTS

2003/0132906 A1* 7/2003 Tanaka ..... G09G 3/2011 345/89
2010/0039453 A1* 2/2010 Chaji ..... G09G 3/20 345/690

(Continued)

*Primary Examiner* — Towfiq Elahi
(74) *Attorney, Agent, or Firm* — Westman, Champlin & Koehler, P.A.

(57) ABSTRACT

Embodiments of the present disclosure provide gamma correction method and device for a display module. The gamma correction method includes: determining, for each sub-pixel of a display module to be corrected, the highest data voltage and the lowest data voltage after gamma correction of the highest gray scale and the lowest gray scale of the display module; determining at least one set of alternative gamma register values that are capable of performing gamma correction of the display module; determining at least one set of gamma register values to be corrected for respective gray scales before the gamma correction of the display module; and performing gamma correction of the display module by adjusting the gamma register value corresponding to the gray scale to be corrected which needs to perform gamma correction.

18 Claims, 2 Drawing Sheets

(52) U.S. Cl.
CPC ..... *G09G 2320/0276* (2013.01); *G09G 2320/0626* (2013.01); *G09G 2320/0673* (2013.01)

(56) References Cited

U.S. PATENT DOCUMENTS

2013/0249955 A1* 9/2013 Kim ..... G09G 3/3233 345/690
2017/0193902 A1* 7/2017 Chen ..... G09G 3/2022

* cited by examiner

GAMMA CORRECTION METHOD AND GAMMA CORRECTION DEVICE FOR DISPLAY MODULE

CROSS-REFERENCE TO RELATED APPLICATION

This application claims the benefit of the Chinese Patent Application No. 201610173900.5 tilted "gamma correction method and gamma correction device for display module" filed on Mar. 24, 2016 in the State Intellectual Property Office of China, the whole disclosure of which is incorporated herein by reference.

BACKGROUND OF THE INVENTION

Field of the Invention

Embodiments of the present disclosure generally relate to the field of gamma correction of a display module, and particularly, to a gamma correction method and a gamma correction device for a display module.

Description of the Related Art

Currently, AMOLED (Active-Matrix Organic Light Emitting Diode) display screen is widely applied in more and more electronic products due to its characteristics such as bright colors, high contrast, faster response, more energy conservation and the like. This is because the AMOLED display screen is of current-driving type, and includes a driving TFT which has an operating point located within a linear region of its transfer characteristic curve and thus has a narrower operating voltage range, such that the AMOLED is very sensitive to a change in a data voltage and a change of voltage small as several millivolts will be presented on display of the display module, Thus gamma correction is required for each display module. During manufacturing the AMOLED, however, the gamma correction of the display module is still an important factor to limit its production efficiency. In an existing gamma correction method for the AMOLED product, optical parameters such as brightness, chromaticity coordinates or the like of respective gray scale associated points are adjusted to target brightness and target chromaticity coordinates. However, there are up to dozens of associated points in the current display module with high resolution screen, thus the gamma correction needs to be performed for a long time, adversely affecting the production efficiency.

To sum up, in conventional gamma correction methods in prior arts, generally, optical parameters such as brightness, chromaticity coordinates or the like of respective gray scale associated points are respectively adjusted to target brightness and target chromaticity coordinates, so that the gamma correction needs to be performed for a display module including a larger number of associated points for a long time.

SUMMARY

An object of the present disclosure is to provide a gamma correction method and a gamma correction device for a display module, for solving the problem that the gamma correction needs to be performed for a long time in conventional gamma correction methods in prior arts.

According to an aspect of the present disclosure, there is provided a gamma correction method for a display module, comprising:

determining, for each sub-pixel of a display module to be corrected, a highest data voltage after gamma correction of a highest gray scale of the display module, and a lowest data voltage after gamma correction of a lowest gray scale of the display module;

determining at least one set of alternative gamma register values that are capable of performing gamma correction of the display module based on the determined highest data voltage and lowest data voltage, at least one set of preset gamma register value corresponding to the display module, and a correspondence between gamma register values and gamma voltage curves;

determining at least one set of gamma register values to be corrected for respective gray scales before the gamma correction of the display module based on the determined at least one set of alternative gamma register values and target gamma curves for the gamma correction of the display module; and performing gamma correction of the display module by adjusting the gamma register value corresponding to the gray scale to be corrected which needs to perform gamma correction based on any of the determined at least one set of gamma register values to be corrected and the target gamma curves.

In an example, determining the highest data voltage after gamma correction of the highest gray scale of the display module and the lowest data voltage after gamma correction of the lowest gray scale of the display module comprises:

adjusting, respectively, a brightness and chromaticity coordinates corresponding to the highest gray scale of the display module to a preset first target brightness and preset first target chromaticity coordinates for gamma correction of the highest gray scale of the display module, and determining the highest data voltage corresponding to the highest gray scale of the display module after the adjusting; and adjusting, respectively, a brightness and chromaticity coordinates corresponding to the lowest gray scale of the display module to a preset second target brightness and preset second target chromaticity coordinates for gamma correction of the lowest gray scale of the display module, and determining the lowest data voltage corresponding to the lowest gray scale of the display module after the adjusting.

In an example, determining at least one set of alternative gamma register values that are capable of performing gamma correction of the display module comprises:

selecting, as the alternative gamma register values for the gamma correction of the display module, at least one set of gamma register values in which a difference between a data voltage corresponding to the highest gray scale and the highest data voltage is less than a first preset threshold and a difference between a data voltage corresponding to the lowest gray scale and the lowest data voltage is less than a second preset threshold.

In an example, the at least one set of alternative gamma register values includes at least five sets of alternative gamma register values.

In an example, determining at least one set of gamma register values to be corrected for respective gray scales before the gamma correction of the display module comprises:

inputting all numerical values of each determined set of the alternative gamma register values into the display module, detecting current brightness and current chromaticity coordinates corresponding to at least one preset gray scale to be detected of the display module when inputting each set of the alternative gamma register values, and determining at least one set of gamma register values to be corrected for respective gray scales before the gamma correction of the display module based on each detected set of the current brightness and the current chromaticity coordinates and target brightness and target chromaticity coordinates corresponding to the gray scale to be detected in the target gamma curve.

In an example, the at least one preset gray scale to be detected is an intermediate gray scale L128.

In an example, performing gamma correction of the display module by adjusting the gamma register value corresponding to the gray scale to be corrected which needs to perform gamma correction comprises:

inputting all numerical values of any of the determined at least one set of gamma register values to be corrected into the display module, detecting current brightness and current chromaticity coordinates corresponding to at least one gray scale to be corrected, which needs to perform gamma correction, of the display module, and adjusting the detected current brightness and the current chromaticity coordinates to target brightness and target chromaticity coordinates corresponding to the gray scale to be corrected in the target gamma curve by adjusting the gamma register value corresponding to the gray scale to be corrected.

In an example, after the gamma correction of the display module, the method further comprises:

saving a set of gamma register values corresponding to the display module after the gamma correction, as reference alternative gamma register values for next gamma correction of a display module which is of the same type as said display module.

In an example, the at least one set of preset gamma register values are at least one set of gamma register values stored in a historical database.

According to another aspect of the present application, it provides a gamma correction device for a display module, comprising:

a data voltage determination module configured to determine, for each sub-pixel of a display module to be corrected, a highest data voltage after gamma correction of a highest gray scale of the display module, and a lowest data voltage after gamma correction of a lowest gray scale of the display module;

an alternative gamma register value determination module configured to determine at least one set of alternative gamma register values that are capable of performing gamma correction of the display module based on the determined highest data voltage and lowest data voltage, at least one set of preset gamma register value corresponding to the display module, and a correspondence between gamma register values and gamma voltage curves;

a module of determining gamma register value to be corrected configured to determine at least one set of gamma register values to be corrected for respective gray scales before the gamma correction of the display module based on the determined at least one set of alternative gamma register values and target gamma curves for the gamma correction of the display module; and a gamma correction module configured to perform gamma correction of the display module by adjusting the gamma register value corresponding to the gray scale to be corrected which needs to perform gamma correction based on any of the determined at least one set of gamma register values to be corrected and the target gamma curves.

In an example, the data voltage determination module is further configured to:

adjust, respectively, the brightness and chromaticity coordinates corresponding to the highest gray scale of the display module to a preset first target brightness and preset first target chromaticity coordinates for gamma correction of the highest gray scale of the display module, and determine the highest data voltage corresponding to the highest gray scale of the display module after adjusting; and adjust, respectively, the brightness and chromaticity coordinates corresponding to the lowest gray scale of the display module to a preset second target brightness and preset second target chromaticity coordinates for gamma correction of the lowest gray scale of the display module, and determine the lowest data voltage corresponding to the lowest gray scale of the display module after adjusting.

In an example, the alternative gamma register value determination module is further configured to:

select, as the alternative gamma register values for the gamma correction of the display module, at least one set of gamma register values in which a difference between a data voltage corresponding to the highest gray scale and the highest data voltage is less than a first preset threshold and a difference between a data voltage corresponding to the lowest gray scale and the lowest data voltage is less than a second preset threshold.

In an example, the at least one set of alternative gamma register values includes at least five sets of alternative gamma register values.

In an example, the module of determining gamma register value to be corrected is further configured to:

input all numerical values of each determined set of the alternative gamma register values into the display module, detect current brightness and current chromaticity coordinates corresponding to at least one preset gray scale to be detected of the display module when inputting each set of the alternative gamma register values, and determine at least one set of gamma register values to be corrected for respective gray scales before the gamma correction of the display module based on each detected set of the current brightness and the current chromaticity coordinates and target brightness and target chromaticity coordinates corresponding to the gray scale to be detected in the target gamma curve.

In an example, the at least one preset gray scale to be detected is an intermediate gray scale L128.

In an example, the gamma correction module is further configured to:

input all numerical values of any of the determined at least one set of gamma register values to be corrected into the display module, detect current brightness and current chromaticity coordinates corresponding to at least one gray scale to be corrected, which needs to perform gamma correction, of the display module, and adjust the detected current brightness and the current chromaticity coordinates to target brightness and target chromaticity coordinates corresponding to the gray scale to be corrected in the target gamma curve by adjusting the gamma register value corresponding to the gray scale to be corrected.

In an example, the gamma correction device further comprises:

a storage module configured to store a set of gamma register values corresponding to the display module after the gamma correction, as reference alternative gamma register values for next gamma correction of a display module which is of the same type as said display module.

In an example, the at least one set of preset gamma register values are at least one set of gamma register values stored in a historical database.

DETAILED DESCRIPTION OF PREFERRED EMBODIMENTS

Embodiments of the present disclosure provide a gamma correction method and a gamma correction device for a display module, for decreasing the time for the gamma correction of the display module with a larger number of associated points. The illustrative embodiments of the present application will be explained with reference the attached drawings. It should be understood that the illustrative embodiments described herein are only intended to explain and interpret the present application, rather than limiting the present application. The embodiments and the features of the embodiments of the present application can be combined with each other, without being conflicted with each other.

Figure 1:
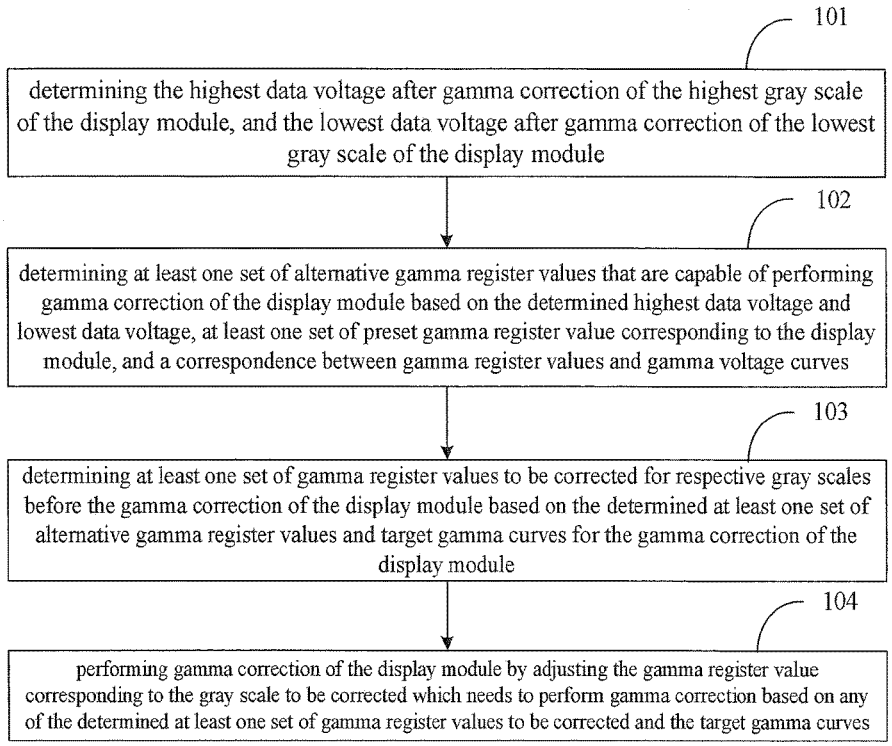
FIG. 1 is a flow chart schematically showing a gamma correction method for a display module according to an embodiment of the present disclosure.

As shown in FIG. 1, it schematically shows a flow chart of a gamma correction method for a display module according to an embodiment of the present disclosure, the method comprising:

step 101: determining, for each sub-pixel of a display module to be corrected, the corresponding highest data voltage after the gamma correction of the highest gray scale of the display module, and the corresponding lowest data voltage after the gamma correction of the lowest gray scale of the display module;

step 102: determining at least one set of alternative gamma register values that are capable of performing gamma correction of the display module based on the determined highest data voltage and lowest data voltage, at least one set of preset gamma register value corresponding to the display module, and a correspondence between gamma register values and gamma voltage curves in a history data;

step 103: determining at least one set of gamma register values to be corrected for respective gray scales before the gamma correction of the display module based on the determined at least one set of alternative gamma register values and target gamma curves for the gamma correction of the display module; and step 104: performing gamma correction of the display module by adjusting the gamma register value corresponding to the gray scale to be corrected which needs to perform gamma correction based on any of the determined at least one set of gamma register values to be corrected and the target gamma curves.

The gamma correction described in the present disclosure is a process during production of the display module; in a conventional gamma correction method, values of brightness and chromaticity coordinates are tested and adjusted for respective associated points in accordance with a certain sequence. Physical variables to which the adjustments are made comprise brightness and chromaticity coordinates, so the gamma correction needs to be performed for a display module including a larger number of associated points for a long time.

In the present disclosure, a relation characteristic between brightness and a data voltage of the display module is utilized, such that brightness and chromaticity coordinates for the highest gray scale and the lowest gray scale are adjusted to target values, and the highest data voltage and the lowest data voltage are determined as reference voltages for other gray scale gamma voltages, and then one set of empirical data, which is most consistent with product specifications is selected from a plurality of sets of empirical data by testing other gray scales. As such, the gamma correction process may be finished quickly, improving production efficiency.

In an implementation, with the gamma correction method for a display module according to embodiments of present disclosure, the display module to be gamma corrected may be an AMOLED display screen, or may be other display screens which need to perform gamma correction. The gamma correction is intended to adjust the brightness and chroma of the display module to target values; in general, the brightness is adjusted in accordance with a curve with a gamma value of 2.2, while the chroma is adjusted as required by a user. R, G and B data voltages corresponding to respective gray scales are generally adjusted such that optical parameters of the display module such as brightness, chromaticity coordinates and the like are adjusted to corresponding target values. Since the gamma correction methods are the same for respective sub-pixels R, G, B of the display module to be corrected, specific steps of the gamma correction method will be described in detail herein.

In order to decrease the time as taken for the gamma correction, the gamma correction method provided according to embodiments of the present disclosure is performed to enable adjustment of a gamma curve of the display module to be corrected to a target curve by use of relation characteristic between the brightness and the data voltage of the AMOLED display module and similarity among gamma voltage curves of products of the same type, which will be described in detail hereinafter.

In an implementation, it is necessary to adjust brightness and chromaticity coordinates of the highest gray scale and the lowest gray scale of the display module to be corrected to target values, so as to determine the highest data voltage and the lowest data voltage as reference voltages for other gray scale gamma voltages. In an example, the step 101 comprises: adjusting, respectively, brightness and chromaticity coordinates corresponding to the highest gray scale of the display module to preset first target brightness and preset first target chromaticity coordinates for gamma correction the highest gray scale of the display module, and determining the highest data voltage corresponding to the highest gray scale of the display module after the adjusting.

Further, in an implementation, generally, the brightness of the highest gray scale is required by the product specifications, and the brightness of other gray scales may be calculated through a brightness formula in prior arts; it is often required that chroma target values for respective gray scales are identical. Gamma correction of the highest gray scale L255 of the display module to be corrected is needed, such that brightness and chromaticity coordinates of the L255 are adjusted to corresponding preset target values (i.e., preset first target brightness and preset first target chromaticity coordinates), and the highest data voltage corresponding to the gray scale L255 of the display module after the adjusting is determined and may be used as the highest reference voltage for all gray scale gamma voltages.

Further, in an example, the step 101 further comprises: adjusting, respectively, the brightness and the chromaticity coordinates corresponding to the lowest gray scale of the display module to a preset second target brightness and preset second target chromaticity coordinates for gamma correction the lowest gray scale of the display module, and determining the lowest data voltage corresponding to the lowest gray scale of the display module after the adjusting. Gamma correction of the lowest gray scale L0 of the display module to be corrected is needed, such that brightness and chromaticity coordinates of the L0 are adjusted to corresponding preset target values (i.e., preset second target brightness and preset second target chromaticity coordinates), and the lowest data voltage corresponding to the gray scale L0 of the display module after the adjusting is determined and may be used as the lowest reference voltage for all gray scale gamma voltages.

For example, taking the highest gray scale L255 as an example, the gamma correction process includes transmitting gamma register values corresponding sub-pixels R, G, B of the highest gray scale L255 by a computer to a driver IC of the display module via a lighting-up machine. Corresponding data voltages are outputted from the driver IC and are applied to the display module with corresponding display of brightness and chroma thereon, and the brightness and chroma are measured and compared to the target brightness and chroma of the highest gray scale L255; then, the gamma register value of the highest gray scale L255 is adjusted and sent to the driver IC so as to drive the display module, which renders changes in brightness and chroma until the brightness and chroma reach target values. In an example, detection apparatuses and operations used in the present disclosure are similar to those in the gamma correction in prior arts, including, for example, apparatuses such as the lighting-up machine, a color analyzer and the like used in the gamma correction process, and thus will be not repeatedly described here. The core idea is to use commonalities among products of the same type to improve production efficiency.

In the present disclosure, the preset first target brightness, the preset first target chromaticity coordinates, the preset second target brightness and the preset second target chromaticity coordinates described above are only intended to be differentiated from each other and do not include particular meanings, but rather, all represent brightness and chromaticity coordinates, that is, the preset first target brightness may have a different value from the preset second target brightness, and the preset first target chromaticity coordinates may also have different values from the preset second target chromaticity coordinates.

In an implementation, after determining the highest data voltage and the lowest data voltage, a gamma register value which conforms to the specifications of the display module may be selected from the historical data based on the highest data voltage and the lowest data voltage, the historical data is in advance obtained by recording a set of gamma register values corresponding to each of display modules which are of the same type and have the same specifications as the display module to be corrected after gamma correction, that is, includes several sets of gamma register values stored in a historical database, and corresponding gamma voltage curves may be calculated from respective sets of gamma register values. Thus, at least one set of alternative gamma register values which enables gamma correction of the display module may be determined based on the determined highest data voltage and the lowest data voltage, several sets of preset gamma register value of the historical data corresponding to the display module, and a correspondence between gamma register values and gamma voltage curves. In the following, determination of the alternative gamma register values will be described in detail.

In an example, the step 102 comprises: selecting, as the alternative gamma register values for the gamma correction of the display module, at least one set of gamma register values in which a difference between a data voltage corresponding to the highest gray scale and the highest data voltage is less than a first preset threshold and a difference between a data voltage corresponding to the lowest gray scale and the lowest data voltage is less than a second preset threshold.

In an implementation, selecting the alternative gamma register values is specified to select, from the historical data, a set of gamma data in which the gamma register values of the highest gray scale and the lowest gray scale are identical with each other, or to select gamma register values in which a data voltage corresponding to the highest gray scale comparatively approximates to the highest data voltage (i.e., a difference between the data voltage corresponding to the highest gray scale and the highest data voltage is less than a first preset threshold), and a data voltage corresponding to the lowest gray scale comparatively approximates to the lowest data voltage (i.e., a difference between the data voltage corresponding to the lowest gray scale and the lowest data voltage is less than a second preset threshold). In an example, what is stored in the historical database is gamma register values of the driver IC of the display module, and the alternative gamma register values are selected with the gamma voltage curves calculated from the gamma register values as reference by comparing the highest data voltage with the lowest data voltage.

It is noted the selected alternative gamma register values includes sets of data, thus at least five sets of gamma register values need to be selected such that the selected gamma register values are more approximate to real gamma register values corresponding to the display module to be corrected. In an example, the at least one set of alternative gamma register values includes at least five sets of alternative gamma register values.

After determining the at least five sets of alternative gamma register values based on the highest data voltage and the lowest data voltage of the display module, it is also necessary to test parameters such as brightness, chromaticity coordinates and the like of other gray scales such that at least one set of the gamma register values which enable the brightness and the chromaticity of the other gray scales closest to the target values is selected from the five sets of alternative gamma register values. In an example, step 103 may particularly comprise: inputting all numerical values of each determined set of the alternative gamma register values into the display module, detecting current brightness and current chromaticity coordinates corresponding to at least one preset gray scale to be detected of the display module when inputting each set of the alternative gamma register values, and determining at least one set of gamma register values to be corrected for respective gray scales before the gamma correction of the display module based on detected sets of the current brightness and the current chromaticity coordinates and target brightness and target chromaticity coordinates corresponding to the gray scale to be detected in the target gamma curve.

In an implementation, all numerical values of each of the determined sets of the alternative gamma register values are inputted into the display module, and current brightness and current chromaticity coordinates corresponding to a particular gray scale (i.e., at least one preset gray scale to be detected) of the display module to be corrected may be detected by a color analyzer or other test instruments when inputting each set of alternative gamma register values and are compared to target brightness and target chromaticity coordinates corresponding to the gray scale on the target gamma curve for the gamma correction of the display module such that one or more sets of gamma register values to be corrected may be determined for respective gray scales before the gamma correction of the display module.

It is noted that the gray scale to be detected may include one or more gray scales which are randomly selected and will not be limited herein, as long as a set of values to be comparatively approximate to the target values can be selected from the five sets of alternative gamma register values. In an example, the gray scale to be detected is the intermediate gray scale L128.

After one or more sets of gamma register values to be corrected have been determined for respective gray scales before the gamma correction of the display module, the gamma correction of the display module may be performed in accordance with the gamma register values to be corrected and the target gamma curves.

In an example, the step 104 may particularly comprise: inputting all numerical values of any of the determined at least one set of gamma register values to be corrected into the display module, detecting current brightness and current chromaticity coordinates corresponding to a plurality of gray scales to be corrected, which needs to perform gamma correction, of the display module, and adjusting the detected current brightness and the current chromaticity coordinates to the target brightness and target chromaticity coordinates corresponding to the gray scale to be corrected in the target gamma curve by adjusting the gamma register value corresponding to the gray scale to be corrected.

After selecting the at least one set of gamma register values, a gamma curve of the display module is tested and compared to a target gamma curve, that is, a set of gamma register values are inputted to display module and are detected and tested; a gamma register value for a gray scale needs to be finely adjusted if it is offset on terms of its target value (i.e., does not meet the product specifications). The target values described herein include brightness and chromaticity coordinates of the gray scale at the associated point, and what is adjusted is the gamma register value of IC corresponding to the gray scale. The gamma correction is finished if the gamma register values meet the product specifications. As such, adjustment of optical parameters of the display module to be corrected is quickly completed. With the gamma correction method provided according to embodiments of the present disclosure, the time required for the gamma correction can be greatly reduced.

It is noted that the fine adjustment finally made to the gamma correction of the gray scale generally relates to adjustment for a low gray scale, including arithmetic adjustment (i.e., adjustments for L0, L16, L32, etc.), or adjustment for a gray scale which has a larger difference relative to the target gamma curve.

After finishing the gamma correction, a corrected set of gamma register values may be saved as historical gamma register values, for example, stored in a historical database. In an example, after the step 104, the method further comprises: saving a set of gamma register values corresponding to the display module after the gamma correction, as reference alternative gamma register values for next gamma correction of a display module which is of the same type as the current display module. The data in the historical database includes gamma register values are obtained after fine adjustment of the gamma correction, that is, includes data which is generated historically for corresponding display modules and completely conforms to the product specifications of the display modules.

Figure 2:
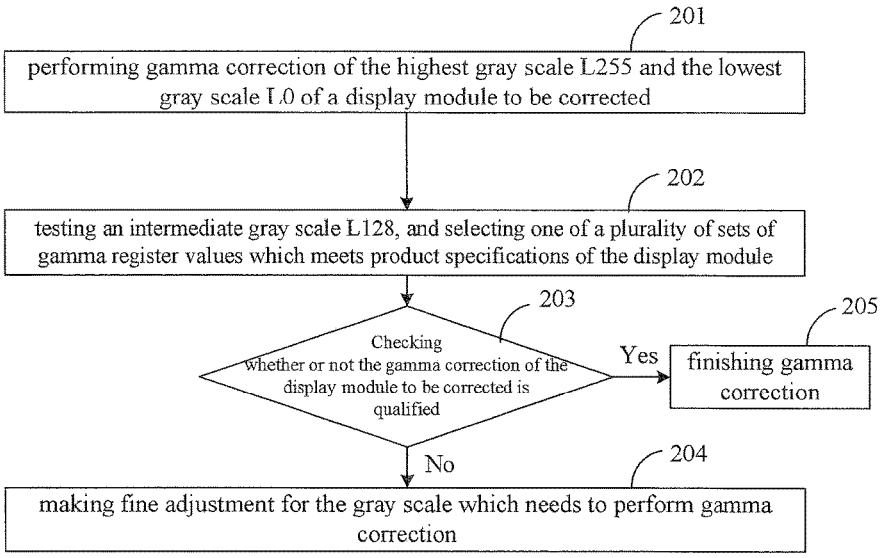
FIG. 2 is an overall flow chart schematically showing a gamma correction method for a display module according to an embodiment of the present disclosure.

In order to more clearly describe the whole process of the gamma correction method for a display module according to embodiments of the present disclosure, there is provided an overall flow chart schematically showing a gamma correction method for a display module according to an embodiment of the present disclosure, as shown in FIG. 2. The method comprises:

step 201: performing gamma correction of the highest gray scale L255 and the lowest gray scale L0 of a display module to be corrected;

step 202: testing an intermediate gray scale L128, and selecting one of a plurality of sets of gamma register values which meets product specifications of the display module;

step 203: checking whether or not the gamma correction of the display module to be corrected is qualified, and if yes, performing step 205, otherwise performing step 204;

step 204: making fine adjustment for the gray scale which needs to perform the gamma correction;

step 205: finishing the gamma correction.

Based on the same inventive concept, an embodiment of the present disclosure further provides a gamma correction device for a display module. A method corresponding to the device shown in FIG. 3 is the gamma correction method for a display module as described above, implementation of the gamma correction device for a display module according to the embodiment of the present disclosure may refer to the implementation of the above method, and repetitive contents will not be described again.

Figure 3:
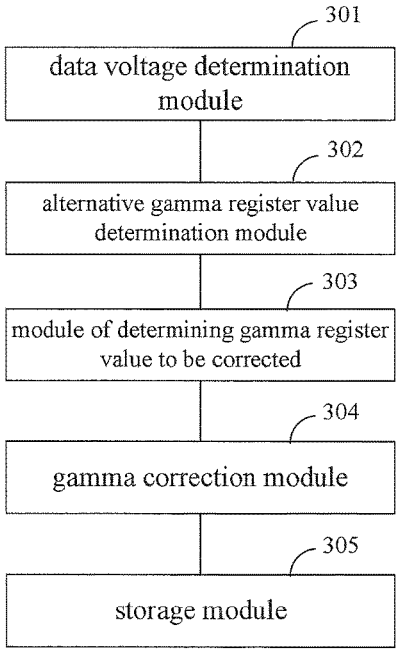
FIG. 3 is a structural schematic diagram of a gamma correction device for a display module according to an embodiment of the present disclosure.

As shown in FIG. 3, it illustrates a structural schematic diagram of a gamma correction device for a display module according to another embodiment of the present disclosure. The device comprises a data voltage determination module 301, an alternative gamma register value determination module 302, a module of determining gamma register value to be corrected 303, a gamma correction module 304 and a storage module 305.

The data voltage determination module 301 is configured to determine, for each sub-pixel of a display module to be corrected, the highest data voltage after gamma correction of the highest gray scale of the display module, and the lowest data voltage after gamma correction of the lowest gray scale of the display module;

the alternative gamma register value determination module 302 is configured to determine at least one set of alternative gamma register values that are capable of performing gamma correction of the display module based on the determined highest data voltage and lowest data voltage, at least one set of preset gamma register value corresponding to the display module, and a correspondence between gamma register values and gamma voltage curves;

the module of determining gamma register value to be corrected 303 is configured to determine at least one set of gamma register values to be corrected for respective gray scales before the gamma correction of the display module based on the determined at least one set of alternative gamma register values and target gamma curves for the gamma correction of the display module; and the gamma correction module 304 is configured to perform gamma correction of the display module by adjusting the gamma register value corresponding to the gray scale to be corrected which needs to perform gamma correction based on any of the determined at least one set of gamma register values to be corrected and the target gamma curves.

In an example, the data voltage determination module 301 may be particularly configured to:

adjust, respectively, a brightness and chromaticity coordinates corresponding to the highest gray scale of the display module to a preset first target brightness and preset first target chromaticity coordinates for gamma correction of the highest gray scale of the display module, and determine the highest data voltage corresponding to the highest gray scale of the display module after adjusting; and adjust, respectively, the brightness and chromaticity coordinates corresponding to the lowest gray scale of the display module to a preset second target brightness and preset second target chromaticity coordinates for gamma correction of the lowest gray scale of the display module, and determine the lowest data voltage corresponding to the lowest gray scale of the display module after adjusting.

In an example, the alternative gamma register value determination module 302 may be particularly configured to:

select, as alternative gamma register values for the gamma correction of the display module, at least one set of gamma register values in which a difference between a data voltage corresponding to the highest gray scale and the highest data voltage is less than a first preset threshold and a difference between a data voltage corresponding to the lowest gray scale and the lowest data voltage is less than a second preset threshold.

In an example, the at least one set of alternative gamma register values includes at least five sets of alternative gamma register values.

In an example, the module of determining gamma register value to be corrected 303 may be particularly configured to:

input all numerical values of each determined set of alternative gamma register values into the display module, detect current brightness and current chromaticity coordinates corresponding to at least one preset gray scale to be detected of the display module when inputting each set of the alternative gamma register values, and determine at least one set of gamma register values to be corrected for respective gray scales before the gamma correction of the display module based on each detected set of the current brightness and the current chromaticity coordinates and target brightness and target chromaticity coordinates corresponding to the gray scale to be detected in the target gamma curve.

In an example, the preset gray scale to be detected is the intermediate gray scale L128.

In an example, the gamma correction module 304 may be particularly configured to:

input all numerical values of any of the determined at least one set of gamma register values to be corrected into the display module, detect current brightness and current chromaticity coordinates corresponding to a plurality of gray scales to be corrected, which need to perform gamma correction, of the display module, and adjust the detected current brightness and the current chromaticity coordinates to the target brightness and target chromaticity coordinates corresponding to the gray scale to be corrected in the target gamma curve by adjusting the gamma register value corresponding to the gray scale to be corrected.

The storage module 305 is configured to store a set of gamma register values corresponding to the display module after the gamma correction, as reference alternative gamma register values for next gamma correction of a display module which is of the same type as the current display module.

As described above, in the present disclosure, a relation characteristic between the brightness and the data voltage of the display module is utilized, such that only the brightness and chromaticity coordinates for the highest gray scale and the lowest gray scale are adjusted to target values, and the highest data voltage and the lowest data voltage are determined as reference voltages for other gray scale gamma voltages, and then one set of empirical data, which is most consistent with product specifications is selected from a plurality of sets of empirical data by testing other gray scales. As such, steps for the gamma correction may be finished quickly, and the time required for the gamma correction of each display module is decreased, thereby improving production efficiency.

The skilled person in the art will appreciate that the embodiments of the present application may be implemented as methods, systems or computer program products. Thus, the present application may be implemented in form of pure hardware embodiments, pure software embodiments or combination of software and hardware embodiments. And the present application may use the form of computer program products implemented on one or more computer readable storage media (including, but not limited to, such as magnetic memory, CD-ROM, or optical memory) in which computer applicable program codes are contained.

The present application is described with reference to the flow charts and/or block diagrams of the methods, apparatuses (systems) and computer program products according to embodiments of the present application. It should be understood that each flow and/or block in the flow chart and/or block diagram and combinations of flow and/or block in the flow chart and/or block diagram may be implemented as computer program instructions. These computer program instructions may be provided to processors of a general computer, a dedicated computer, an embedded processing device or other programmable data process apparatuses to generate a machine such that the instructions that are executed by the processor of the computer or other programmable data process apparatus generate means for achieving specified functions in one or more flows of the flow chart and/or one or more blocks of the block diagram.

These computer program instructions may also be stored in a computer readable memory that can guide the computer or other programmable data process apparatus to work in a certain manner, such that the instructions stored in the computer readable memory generate manufactures including instruction devices. The instruction devices may achieve the specified functions in one or more flows of the flow chart and/or one or more blocks of the block diagram.

These computer program instructions may also be loaded on the computer or other programmable data process apparatus, such that a series of operation steps may be executed on the computer or other programmable apparatuses to generate computer implementable processes. In this way, the instructions executed on the computer or other programmable apparatus may provide steps of achieving the specified functions in one or more flows of the flow chart and/or one or more blocks of the block diagram.

Although several exemplary embodiments have been shown and described, it would be appreciated by those skilled in the art that various changes or modifications may be made in these embodiments without departing from the principle and spirit of the disclosure. These changes and modifications will also fall within the scope of the present application, delimited by appended claims and equivalents thereof.

What is claimed is:

1. A gamma correction method for a display module, comprising:

determining, for each sub-pixel of a display module to be corrected, a highest data voltage after gamma correction of a highest gray scale of the display module, and a lowest data voltage after gamma correction of a lowest gray scale of the display module, by means of adjusting brightness and chromaticity coordinates for the highest gray scale and the lowest gray scale to target values;

determining at least one set of alternative gamma register values that are capable of performing gamma correction of the display module based on the determined highest data voltage and lowest data voltage, at least one set of preset gamma register value corresponding to the display module, and a correspondence between gamma register values and gamma voltage curves;

determining at least one set of gamma register values to be corrected for respective gray scales before the gamma correction of the display module based on the determined at least one set of alternative gamma register values and target gamma curves for the gamma correction of the display module; and performing gamma correction of the display module by adjusting a corresponding gamma register value to the gray scale to be corrected which needs to perform gamma correction based on any of the determined at least one set of gamma register values to be corrected and the target gamma curves.

2. The method according to claim 1, wherein determining the highest data voltage after gamma correction of the highest gray scale of the display module and the lowest data voltage after gamma correction of the lowest gray scale of the display module comprises:

adjusting, respectively, a brightness and chromaticity coordinates corresponding to the highest gray scale of the display module to a preset first target brightness and preset first target chromaticity coordinates for gamma correction of the highest gray scale of the display module, and determining the highest data voltage corresponding to the highest gray scale of the display module after the adjusting; and adjusting, respectively, a brightness and chromaticity coordinates corresponding to the lowest gray scale of the display module to a preset second target brightness and preset second target chromaticity coordinates for gamma correction of the lowest gray scale of the display module, and determining the lowest data voltage corresponding to the lowest gray scale of the display module after the adjusting.

3. The method according to claim 1, wherein determining at least one set of alternative gamma register values that are capable of performing gamma correction of the display module comprises:

selecting, as the alternative gamma register values for the gamma correction of the display module, at least one set of gamma register values in which a difference between a data voltage corresponding to the highest gray scale and the highest data voltage is less than a first preset threshold and a difference between a data voltage corresponding to the lowest gray scale and the lowest data voltage is less than a second preset threshold.

4. The method according to claim 3, wherein the at least one set of alternative gamma register values includes at least five sets of alternative gamma register values.

5. The method according to claim 1, wherein determining at least one set of gamma register values to be corrected for respective gray scales before the gamma correction of the display module comprises:

inputting all numerical values of each determined set of the alternative gamma register values into the display module, detecting current brightness and current chromaticity coordinates corresponding to at least one preset gray scale to be detected of the display module when inputting each set of the alternative gamma register values, and determining at least one set of gamma register values to be corrected for respective gray scales before the gamma correction of the display module based on each detected set of the current brightness and the current chromaticity coordinates and target brightness and target chromaticity coordinates corresponding to the gray scale to be detected in the target gamma curve.

6. The method according to claim 5, wherein the at least one preset gray scale to be detected is an intermediate gray scale L128.

7. The method according to claim 1, wherein performing gamma correction of the display module by adjusting the gamma register value corresponding to the gray scale to be corrected which needs to perform gamma correction comprises:

inputting all numerical values of any of the determined at least one set of gamma register values to be corrected into the display module, detecting current brightness and current chromaticity coordinates corresponding to at least one gray scale to be corrected, which needs to perform gamma correction, of the display module, and adjusting the detected current brightness and the current chromaticity coordinates to target brightness and target chromaticity coordinates corresponding to the gray scale to be corrected in the target gamma curve by adjusting the gamma register value corresponding to the gray scale to be corrected.

8. The method according to claim 1, wherein after the gamma correction of the display module, the method further comprises:

saving a set of gamma register values corresponding to the display module after the gamma correction, as reference alternative gamma register values for next gamma correction of a display module which is of the same type as said display module.

9. The method according to claim 1, wherein the at least one set of preset gamma register values are at least one set of gamma register values stored in a historical database.

10. A processor for performing the following steps, comprising:

a data voltage determination step:

to determine, for each sub-pixel of a display module to be corrected, a highest data voltage after gamma correction of a highest gray scale of the display module, and a lowest data voltage after gamma correction of a lowest gray scale of the display module, by means of adjusting brightness and chromaticity coordinates for the highest gray scale and the lowest gray scale to target values;

an alternative gamma register value determination step to determine at least one set of alternative gamma register values that are capable of performing gamma correction of the display module based on the determined highest data voltage and lowest data voltage, at least one set of preset gamma register value corresponding to the display module, and a correspondence between gamma register values and gamma voltage curves;

a step of determining gamma register value to be corrected, to determine at least one set of gamma register values to be corrected for respective gray scales before the gamma correction of the display module based on the determined at least one set of alternative gamma register values and target gamma curves for the gamma correction of the display module; and a gamma correction step to perform gamma correction of the display module by adjusting a corresponding gamma register value to the gray scale to be corrected which needs to perform gamma correction based on any of the determined at least one set of gamma register values to be corrected and the target gamma curves.

11. The processor according to claim 10, wherein the data voltage determination step is further configured to:

adjust, respectively, the brightness and chromaticity coordinates corresponding to the highest gray scale of the display module to a preset first target brightness and preset first target chromaticity coordinates for gamma correction of the highest gray scale of the display module, and determine the highest data voltage corresponding to the highest gray scale of the display module after adjusting; and adjust, respectively, the brightness and chromaticity coordinates corresponding to the lowest gray scale of the display module to a preset second target brightness and preset second target chromaticity coordinates for gamma correction of the lowest gray scale of the display module, and determine the lowest data voltage corresponding to the lowest gray scale of the display module after adjusting.

12. The processor according to claim 10, wherein the alternative gamma register value determination module is further configured to:

select, as the alternative gamma register values for the gamma correction of the display module, at least one set of gamma register values in which a difference between a data voltage corresponding to the highest gray scale and the highest data voltage is less than a first preset threshold and a difference between a data voltage corresponding to the lowest gray scale and the lowest data voltage is less than a second preset threshold.

13. The processor according to claim 12, wherein the at least one set of alternative gamma register values includes at least five sets of alternative gamma register values.

14. The processor according to claim 10, wherein the step of determining gamma register value to be corrected is further configured to:

input all numerical values of each determined set of the alternative gamma register values into the display module, detect current brightness and current chromaticity coordinates corresponding to at least one preset gray scale to be detected of the display module when inputting each set of the alternative gamma register values, and determine at least one set of gamma register values to be corrected for respective gray scales before the gamma correction of the display module based on each detected set of the current brightness and the current chromaticity coordinates and target brightness and target chromaticity coordinates corresponding to the gray scale to be detected in the target gamma curve.

15. The processor according to claim 14, wherein the at least one preset gray scale to be detected is an intermediate gray scale L128.

16. The processor according to claim 10, wherein the gamma correction step is further configured to:

input all numerical values of any of the determined at least one set of gamma register values to be corrected into the display module, detect current brightness and current chromaticity coordinates corresponding to at least one gray scale to be corrected, which needs to perform gamma correction, of the display module, and adjust the detected current brightness and the current chromaticity coordinates to target brightness and target chromaticity coordinates corresponding to the gray scale to be corrected in the target gamma curve by adjusting the gamma register value corresponding to the gray scale to be corrected.

17. The processor according to claim 10, wherein the processor further comprises:

a storage module configured to store a set of gamma register values corresponding to the display module after the gamma correction, as reference alternative gamma register values for next gamma correction of a display module which is of the same type as said display module.

18. The processor according to claim 10, wherein the at least one set of preset gamma register values are at least one set of gamma register values stored in a historical database.

* * * * *